US011503930B2

(12) United States Patent
Silva

(10) Patent No.: US 11,503,930 B2
(45) Date of Patent: Nov. 22, 2022

(54) MULTI-USE ERGONOMIC PILLOW

(71) Applicant: Patrick Kenneth Silva, Mountlake Terrace, WA (US)

(72) Inventor: Patrick Kenneth Silva, Mountlake Terrace, WA (US)

( * ) Notice: Subject to any disclaimer, the term of this patent is extended or adjusted under 35 U.S.C. 154(b) by 198 days.

(21) Appl. No.: 17/161,890

(22) Filed: Jan. 29, 2021

(65) Prior Publication Data

US 2021/0235899 A1 Aug. 5, 2021

Related U.S. Application Data

(60) Provisional application No. 62/968,064, filed on Jan. 30, 2020.

(51) Int. Cl.
*A47G 9/10* (2006.01)

(52) U.S. Cl.
CPC ..... *A47G 9/1009* (2013.01); *A47G 9/1081* (2013.01); *A47G 2009/1018* (2013.01)

(58) Field of Classification Search
CPC .. A47G 9/1009; A47G 9/1081; A47G 9/0253; A47G 9/109
See application file for complete search history.

(56) References Cited

U.S. PATENT DOCUMENTS 1,447,288 A * 3/1923 Emmerich ..... A47G 9/10 5/645
4,550,459 A * 11/1985 Endel ..... A47G 9/10 5/636
4,689,844 A * 9/1987 Alivizatos ..... A47D 15/008 297/452.16
4,756,035 A * 7/1988 Beier ..... A47G 9/1081 5/643
4,956,886 A * 9/1990 Sarkozi ..... A47G 9/10 5/636
5,020,174 A * 6/1991 Sarkozi ..... A47G 9/10 5/951
5,271,114 A * 12/1993 Kjersem ..... A47G 9/10 5/636
5,987,676 A * 11/1999 Littleford ..... A47G 9/10 5/636
6,363,557 B2 4/2002 Chou
6,442,778 B1 * 9/2002 Shaharbani ..... A47G 9/10 5/636

(Continued)

FOREIGN PATENT DOCUMENTS

DE 202012001030 U1 * 5/2012 ..... A47G 9/109
WO WO-2014122483 A1 * 8/2014 ..... A47G 9/10

*Primary Examiner* — Eric J Kurilla
(74) *Attorney, Agent, or Firm* — Binita J. Singh; Bold IP, PLLC

(57) ABSTRACT

A multi-use pillow that provides for a shape guided by and contemplated for use in therapeutics, ergonomics, and comfort. The multi-use pillow comprises of an outer shell configured with a first enclosure, a second enclosure, and a channel separating the two enclosures. A first inner pod and a second inner pod are received into the first enclosure and the second enclosure, respectively, and are structured to conform to a size of their respective enclosures. The multi-use pillow may be folded at the channel and allow the pillow to be adapted for use as a stacked pillow or back support. The multi-use pillow may also be adapted for several sleeping styles conforming to proper lumbar and neck support.

20 Claims, 4 Drawing Sheets

(56) References Cited

U.S. PATENT DOCUMENTS

| | | | | |
|---|---|---|---|---|
| 6,601,252 | B1 * | 8/2003 | Leach | A47C 3/16 5/643 |
| D613,105 | S * | 4/2010 | Chuang | D6/601 |
| 8,276,227 | B2 | 10/2012 | Pileggi | |
| 10,383,466 | B2 * | 8/2019 | Wilmarth | A47C 20/025 |
| 10,561,259 | B1 * | 2/2020 | Gaspari | A47G 9/109 |
| 10,980,365 | B1 * | 4/2021 | Ogden | A47G 9/0253 |
| 11,109,698 | B1 * | 9/2021 | Ogden | A47G 9/0253 |
| D939,245 | S * | 12/2021 | Medina | D6/601 |
| 2006/0123547 | A1 * | 6/2006 | Ferber | A47G 9/10 5/636 |
| 2008/0028529 | A1 * | 2/2008 | Abell | A47G 9/0253 5/636 |
| 2011/0145994 | A1 * | 6/2011 | Pileggi | A47G 9/1081 5/490 |
| 2011/0271453 | A1 * | 11/2011 | Gandhi | A47G 9/1081 5/640 |
| 2012/0222218 | A1 * | 9/2012 | Davis | A47G 9/1072 5/490 |
| 2013/0031723 | A1 * | 2/2013 | Parnham | A47G 9/1081 5/645 |
| 2014/0000034 | A1 * | 1/2014 | Alexander | A47G 9/1081 5/636 |
| 2014/0115787 | A1 * | 5/2014 | Garcia | A47G 9/10 5/636 |
| 2015/0230635 | A1 * | 8/2015 | Abrams | A47G 9/1081 5/636 |
| 2022/0287483 | A1 * | 9/2022 | Fischenich | A47G 9/0253 |

* cited by examiner

MULTI-USE ERGONOMIC PILLOW

CROSS REFERENCE TO RELATED APPLICATION

This application claims benefit of U.S. Provisional Application No. 62/968,064 filed on Jan. 30, 2020, which is incorporated by reference in its entirety.

FIELD OF THE INVENTION

The overall field of this invention is directed to pillows and pillow inserts, and more particularly to therapeutic or ergonomic pillows for various head and neck support.

BACKGROUND OF THE INVENTION

A pillow is a mass produced and generally useful tool. It provides comfort and support to the head and neck and sometimes other parts of the body. Various types of pillows are available for providing comfort and support. Nearly everyone needs a pillow and each individual has their own sleep habits in the context of how they use a pillow. However, most pillows are not used satisfactorily and in general, nearly a third of the pillow surface is underutilized. People may have multiple pillows to suit their environment and situation. More importantly, because the pillows are not designed properly, many people experience chronic pain and other neuromusculoskeletal problems. These problems can be aggravated by poor head and neck positioning on the pillows.

Thus, there remains a need for a pillow that accounts for these deficiencies and focuses on an improved product utilizing ergonomics especially toward improved sleep habits. There remains a need for a pillow that can be a treatment tool for chronic pains such as headaches from poor sleep positions. There remains a need for a pillow that can be slept on in any position. There also remains a need for a pillow that can be elevated to reduce the use of two stacked pillows. Thus, there remains a need for a pillow that is low cost, simple to produce, and includes the parameters above all in one pillow.

The presently described invention provides such a desirable pillow device and methods of using the device.

SUMMARY OF THE INVENTION

Accordingly, the present disclosure provides for a low cost, simple to produce, and an accessible pillow that utilizes ergonomics leading to proper posture especially toward improved sleep habits. The present disclosure provides for a pillow that can be a treatment tool for chronic pains such as headaches from poor sleep positions. The present disclosure also provides for a pillow that can be slept on in any position. Additionally, the present disclosure also provides for a pillow that can be elevated to reduce the use of two stacked pillows. Thus, the disclosure provides a pillow that encompasses several benefits into one pillow The device as disclosed in the non-limiting embodiments is an ergonomic and therapeutic multi-use pillow. The multi-use pillow is sized and shaped to provide proper support and comfort to a user and accommodate many sleeping styles. The multi-use pillow may be used lying flat in a horizontal position, lying flat in a vertical position, or a folded position, and the multi-use pillow can be used on a floor, a bed, a chair, or a sofa. In any of the positions, the multi-use pillow is designed to support an ergonomic head and neck position in relation to a user's back and shoulders.

The multi-use pillow may be regarded as modular and be comprised of at least two enclosure sections. Alternate embodiments may include more than two enclosure sections. The two enclosure sections may be separated by a channel created by two longitudinal seams along a line and positioned such that one enclosure section is smaller in width than the other section. The channel created by the seams is wide enough such that it may be folded along that channel when the multi-use pillow has filling in it. The two enclosure sections may have openings with a preference for an enveloping flap at the opening. Alternate embodiments may include other closure means. These openings allow the fill material for each section, which is encapsulated in removable inner pods, to be insertable into their respective enclosure sections in the pillow. The inner pods may include varying levels of fill material including and not limited to soft, medium, and hard. Alternate embodiments may include different sizes of pillow, including and not limited to a standard, a queen, a body, and a king size.

DETAILED DESCRIPTION OF THE INVENTION

Figure 1:
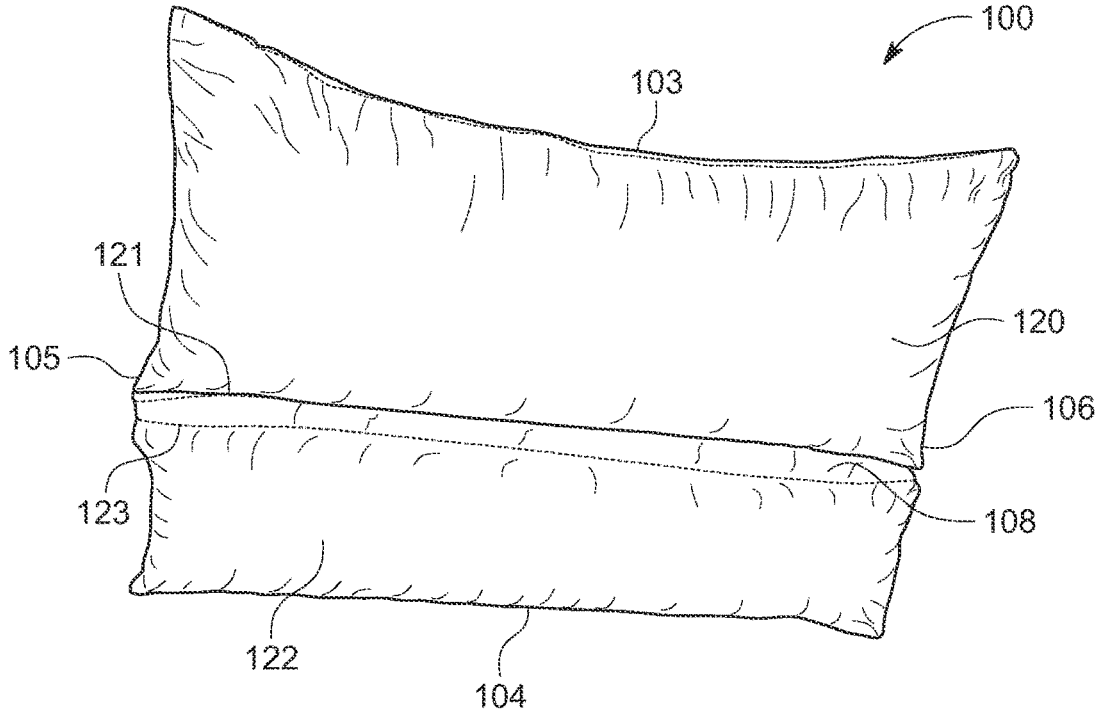
FIG. 1 illustrates a top perspective view of an embodiment of a multi-use pillow.

In the Summary above and in this Detailed Description, and the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, steps, among others, are optionally present. For example, an article "comprising" (or "which comprises") components A, B, and C can consist of (i.e., contain only) components A, B, and C, or can contain not only components A, B, and C but also contain one or more other components.

The following description provides preferred exemplary embodiments only and is not intended to limit the scope, applicability, or configuration of the invention. The following description of the preferred exemplary embodiment will provide those skilled in the art with an enabling description for implementing a preferred exemplary embodiment of the invention. It shall be understood that various changes may be made in the function and arrangement of elements without departing from the scope of the invention as set forth in the claims.

The presently disclosed invention relates to a multi-use pillow designed to provide ergonomic and therapeutic support for a user's head and neck. As used herein, the presently disclosed invention may be conveniently referred to as "a multi-use pillow" or "the multi-use pillow." The multi-use pillow as used herein is generally designated for use as an ergonomic and therapeutic pillow and provides a device which may be used in several ways as detailed herein to provide proper support and comfort for a user using the device.

In a non-limiting preferred embodiment, the multi-use pillow has an overall shape or configuration that, when viewed from the top has essentially two enclosure sections separated from each other by a channel wherein one enclosure section is longer in width than the other. The channel creates some space between the two enclosures and further offers the ergonomic and therapeutic functionality to the multi-use pillow. The multi-use pillow may be folded at the channel and used in multiple positions for offering the appropriate support and comfort desired by a user. The channel may also allow the user to place their head and neck in an ergonomic position without having to position the head and neck at painful angles.

The multi-use pillow, in the non-limiting embodiments described herein, is comprised of an outer shell and at least two inner pods. The outer shell is separated into and is comprised of at least two enclosure sections, a first enclosure and a second enclosure. Additionally, the outer shell is also comprised of a channel which creates a space between the two enclosure sections and essentially separates the two enclosure sections from each other. The channel runs between the entire length of the two enclosure sections. The channel is also configured to serve as a hinge such that the enclosure sections may fold at the channel. The first enclosure section and the second enclosure section are configured into the outer shell with unequal widths to offer ideal head and neck support geared toward providing a suitable ergonomic and therapeutic support to a user. Alternatively, the multi-use pillow may also be constructed with a first enclosure section and a second enclosure section that are substantially equal in size and having an equal overall width. The non-limiting embodiment is described as having at least two enclosure sections however, it is within the realm of this disclosure that alternate embodiments may include more than two sections which may be guided by and contemplated for use in therapeutics, ergonomics, and comfort.

The outer shell may be fashioned from fabric material. The fabric material may be selected from any number of applicable fabrics, as known in the arts. Such fabrics and materials include, but are not limited to, cotton, rayon, silk, ballistic nylon, polyester, or blends thereof. Preferably, the outer shell will be washable. The outer shell may have a general rectangular shape of pillows as known in the arts. The dimensions of the outer shell measure in accordance with generally available pillows as known in the arts, including measurements corresponding to and not limited to, a standard pillow, a queen pillow, a king pillow, and a body pillow. Alternative embodiments also comprise a general square shape, including measurements corresponding to and not limited to a euro pillow. Additional embodiments of a multi-use pillow also comprise of dimensions and measurements of a travel size pillow. The dimensions above are exemplary and do not limit the size of the multi-use pillow in any respect. Accordingly, the size of the multi-use pillow may be altered and each of the dimensions may vary plus or minus a range of measurements, including, but not limited to, +/−0.25", 0.5", 0.75". 1", 2", 3", 4" and the like.

In a non-limiting preferred embodiment, the outer shell has a length and a width and also includes a front side and a back side. The outer shell is generally assembled by joining the front side and the back side and stitching along a top edge, a bottom edge, and a side edge. In this embodiment, an opening is created by leaving an edge, an open edge, opposite the side edge unstitched. The open edge provides an opening into the outer shell. The top edge and the bottom edge may comprise the length of the outer shell, and the side edge and the open edge may comprise the width of the outer shell.

The outer shell is further separated into at least two enclosures, the first enclosure and the second enclosure. In the preferred embodiment, the first enclosure and the second enclosure are of unequal size, wherein the first enclosure has a width that is longer than the width of the second enclosure. The first enclosure and the second enclosure are created by two separate seams, a first seam and a second seam which also join the front side and the back side of the outer shell together. The first seam runs longitudinally along the length of the outer shell from the open edge to the side edge and relatively parallel to the top edge. The second seam also runs longitudinally along the length of the outer shell from the open edge to the side edge and is relatively parallel to the bottom edge. The first seam and the second seam are also relatively parallel to each other and placed in close proximity to each other and within a region of the outer shell which separates the first enclosure and the second enclosure with unequal widths. Alternatively, the first seam and the second seam may also be placed centrally such that the first enclosure and the second enclosure are of equal widths.

In this non-limiting embodiment, the first seam and the second seam are generally formed slightly apart from each other such that a channel is created between the first seam and the second seam and thus also between the first enclosure and the second enclosure. In separating the outer shell into the first enclosure and the second enclosure, the first seam and the second seam also separate the open edge into three open edges, a first open edge, a second open edge, and a channel open edge, corresponding to the first enclosure, the second enclosure, and the channel, respectively. Alternatively, the channel open edge may be closed by placing a seam at the channel open edge. The channel comprises part of the multi-use pillow and the configuration allows the multi-use pillow to be foldable at the channel. In a preferred embodiment, the channel may have a width dimension measuring approximately 1 inch. This dimension is exemplary and does not limit the size of the channel in any respect. Accordingly, the size of the channel may vary plus or minus a range of measurements, including, but not limited to a range of at least +/−0.5 inches from the non-limiting embodiment of 1 inch.

In alternative embodiments, the presently disclosed multi-use pillow can also be comprised of a channel that is less flexible and resistant to being readily foldable. The channel, in this embodiment, may be comprised of a material that would make it less flexible. The channel may be augmented with material such as, and not limited to a nylon strap of equal width to the channel width and traverse the entire length of the channel. The inflexible material may be sewn into the channel between the top side and the bottom side.

Alternatively, the inflexible material may be removably inserted into the channel at the channel open edge and thus offering a user of the multi-use pillow the option and flexibility to adjust the foldable aspect of the multi-use pillow to their liking.

In the preferred embodiment, the first open edge and the second open edge of the first enclosure and the second enclosure, respectively, create an opening into each enclosure. In this embodiment, the first open edge and the second open edge also comprise an enveloping flap. Each enclosure is designed to accommodate an inner pod (discussed below), and the enveloping flap is designed to help secure each inner pod within the enclosures in a seamless manner. Alternatively, other closure means to secure the inner pods within the two enclosures may include the open edge integrated with a fastening means such as a zipper, hook and loop fasteners, VELCRO, buttons, and the like.

The multi-use pillow is also comprised of at least two inner pods, a first inner pod and a second inner pod which are designed to be inserted into the first enclosure and the second enclosure, respectively. The inner pods are comprised of a fill material encapsulated within a fabric material. The inner pods are sized to fit snugly within the two enclosures. In the preferred embodiment, the width of the first enclosure is longer than the width of the second enclosure and thus the first inner pod and the second inner pod are sized accordingly and corresponding to the first enclosure and the second enclosure, respectively. Thus, the first inner pod has a similar width to and fits within the first enclosure, and the second inner pod has a similar width to and fits within the second enclosure.

The first inner pod and the second inner pod are each intended to be a seamless pillow filling and designed to make the multi-use pillow modular. The first and the second inner pods may include varying fill densities such as a soft fill, a medium fill, and a firm fill among others. The first and the second inner pods may be customizable wherein an individual may choose the same fill densities for both inner pods or choose to include different fill densities for the first and the second inner pods (e.g., first inner pod may have a medium fill density and the second inner pod may have a firm fill density). The fill material for the inner pods may include material such as cotton, feathers, down, polyester, combination of feather and down, husks, beads, beans, pits, foam variants (e.g., molded foam material, shaped foam material, or other suitable yielding material) or any combination or any other material known in the arts.

In a preferred embodiment, the multi-use pillow as presently disclosed can be used on a flat surface as a headrest when a user is in a prone position (e.g., laying down). The smaller enclosure section may be closer to the user of the multi-use pillow. In this position, the multi-use pillow allows a user to lay on their side and comfortably place the convexity of their head in the channel of the multi-use pillow such that the neck is supported by the smaller enclosure section of the multi-use pillow. Alternatively, in the disclosed embodiment, a user may lay on their back and place the back of their head in the channel of the multi-use pillow with the neck supported by the smaller enclosure section. In both of these applications, the user is positioned ergonomically such that the neck is in line with the spine rather than having the neck positioned at an angle and preventing excessive force from being exerted on the neck to provide neck and head support to the person in the lying position.

Alternatively, a user may prefer to place their head on the larger enclosure section with the neck and shoulders off the multi-use pillow. In this position, the larger section is closer to a user with the head resting on the larger enclosure section and the base of the neck and shoulders off the multi-use pillow.

The presently described multi-use pillow can also be used in a folded position. In this configuration, the multi-use pillow may be folded at the channel and placed on a flat surface or against a headboard or a sofa back. A person may then either lay prone with their shoulders resting on the multi-use pillow or sit more upright with the multi-use pillow at the back, the shoulders or the neck and thereby conforming to the natural shape of the lordotic cervical region or supporting the neck and the shoulders to relieve any excessive pressure in these areas.

Figure 2:
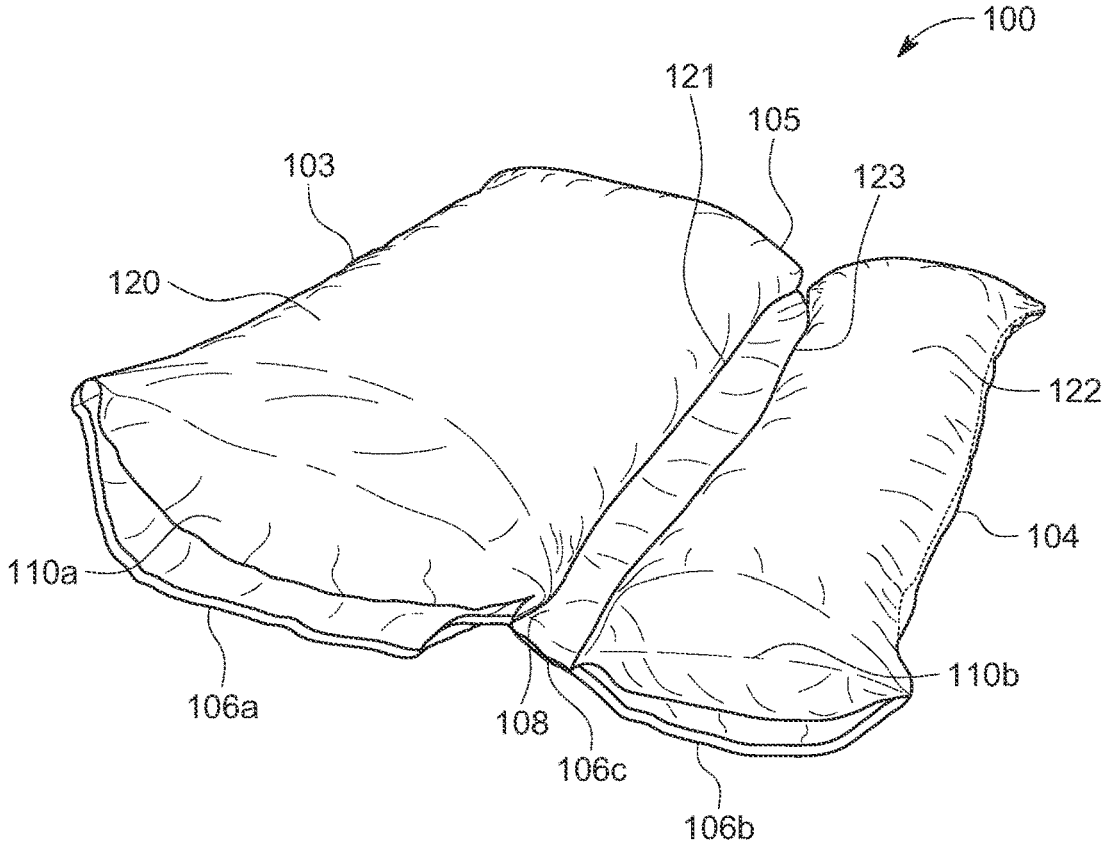
FIG. 2 illustrates a side angled view of the multi-use pillow.
Figure 3A:
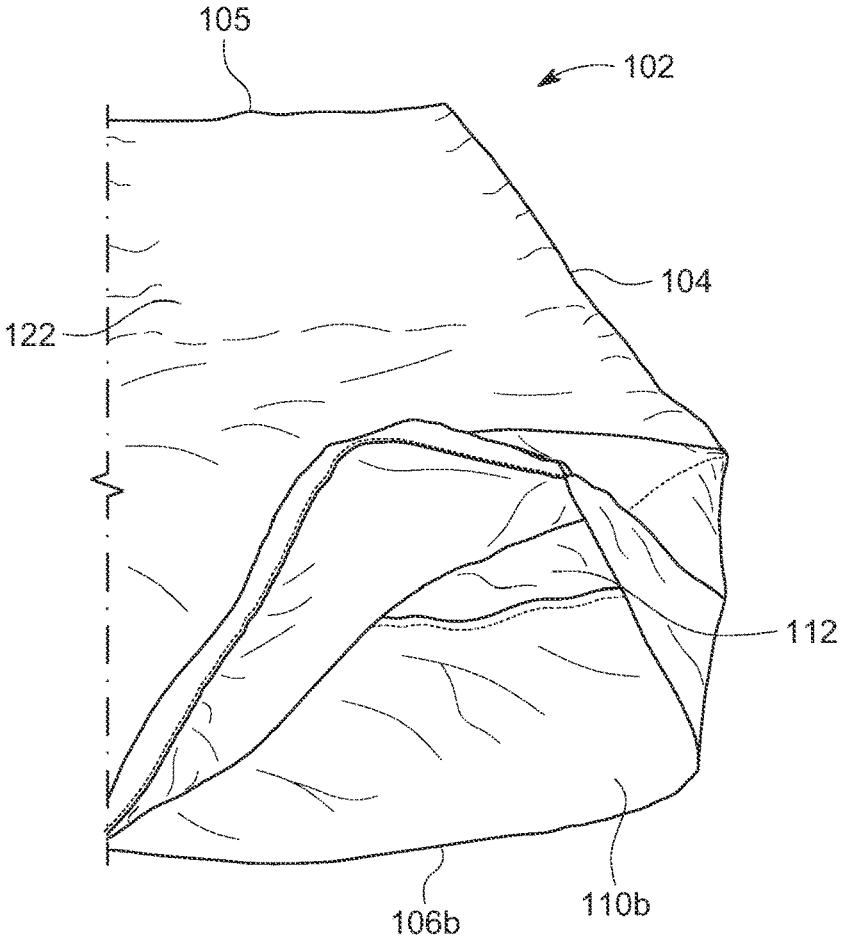
FIG. 3A is a close-up perspective view of a section of the multi-use pillow illustrating an open edge in an outer shell of the multi-use pillow.
Figure 3B:
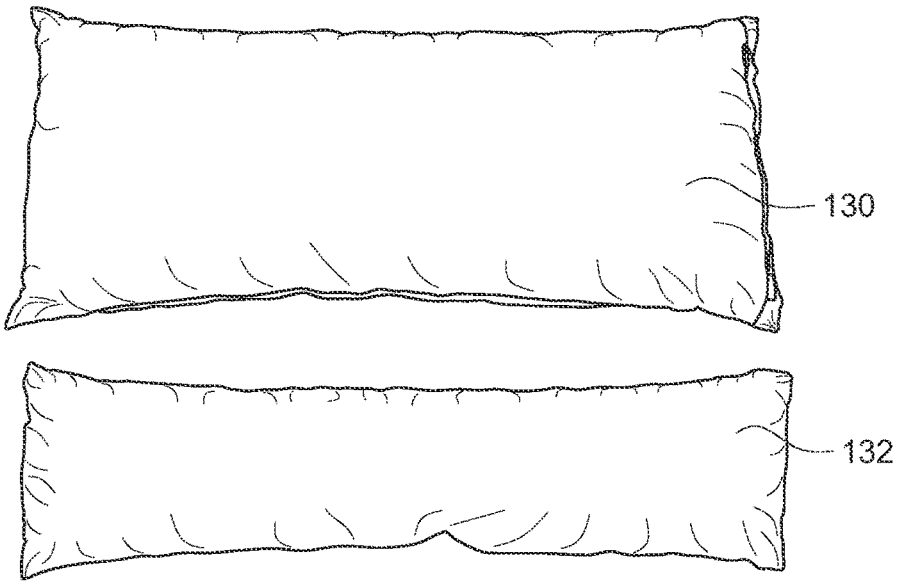
FIG. 3B is a perspective view of a first inner pod and a second inner pod of the multi-use pillow.

With reference now to the figures, FIG. 1, FIG. 2, FIGS. 3A, and 3B show one exemplary embodiment of the presently disclosed multi-use ergonomic pillow, such as multi-use pillow 100. FIG. 1 shows a top perspective view of this exemplary embodiment and FIG. 2 shows a side angled view. FIG. 3A and FIG. 3B illustrate a close up view of components comprising part of the multi-use pillow 100. FIG. 3A illustrates the multi-use ergonomic pillow 100 comprising of an outer shell 102 and FIG. 3B illustrates the multi-use pillow as comprising of at least two inner pods, such as first inner pod 130 and second inner pod 132.

The outer shell 102 of the multi-use pillow 100 includes a front side and a back side (not shown in the figures) and four edges. The front side and the back side are generally joined together with stitching along three of the edges of the multi-use pillow 100, a top edge 103, a bottom edge 104, and a side edge 105. The front side and the back side of the outer shell 102 are not joined together at one of the edges, referred to as an open edge 106. The outer shell 102 has a length and width, wherein the top edge 103 and the bottom edge 104 correspond with the length; and the side edge 105 and the open edge 106 correspond with the width.

FIGS. 1 and 2 illustrate the multi-use pillow 100 with the first and second inner pods (see, FIG. 3B, 130 and 132) inserted into the outer shell 102 of the multi-use pillow 100. In the presently disclosed preferred embodiment, the multi-use pillow 100 is shown to be comprised of two enclosure sections, a first enclosure 120 and a second enclosure 122. In this embodiment, the first enclosure 120 and the second enclosure 122 have a length and a width wherein the length corresponds with the length of the outer shell 102. However, as illustrated in FIGS. 1 and 2, the width of the outer shell 102 is split into two unequal widths to correspond with the widths of the first enclosure 120 and the second enclosure 122. The first enclosure 120 is longer in width than the second enclosure 122.

The first enclosure 120 and the second enclosure 122 are illustrated as being separated by a channel 108. The channel 108 is created by at least two seams, a first seam 121 and a second seam 123 that may be parallel to each other and which extend longitudinally along the length of the outer shell from the open edge 106 to the side edge 105. The first seam 121 and the second seam 123 in creating the channel 108 also help in creating the first enclosure 120 and the second enclosure 122. FIG. 2 also illustrates that the first seam 121 and the second seam 123 also separate the open edge 106 into three separate sections, first open edge 106*a*, second open edge 106*b*, and channel open edge 106*c*, which correspond to the first enclosure 120, second enclosure 122, and the channel 108, respectively.

As illustrated in FIG. 2, a multi-use pillow 100 is shown with a closure means, such as a first enveloping flap 110*a* and a second enveloping flap 110*b*. FIG. 3A illustrates a closer view of the second enclosure 122 with an opening 112 on the open edge 106*b* side. The second enclosure 122 does not have the second inner pod 132 inserted into it to illustrate the opening 112 and the second enveloping flap 110*b*. Referring to FIG. 2, the first and second enveloping flaps 110*a* and 110*b* are integrated through the first open edge 106*a* of the first enclosure 120 and the second open edge 106*b* of the second enclosure 122, respectively. The first and second enveloping flaps 110*a* and 110*b* cover an opening 112 (see, FIG. 3A) which is created at each of the first open edge 106*a* (opening not shown) and the second open edge 106*b* by leaving the top side and the back side of the multi-use pillow 100 unstitched at the open edge 106. As shown in FIG. 2, first and second enveloping flaps 110*a* and 110*b* cover and secure the first inner pod and the second inner pod (not shown in FIG. 2) within the first enclosure 120 and the second enclosure 122, respectively.

In the non-limiting embodiment as described before, FIG. 3B illustrates the first inner pod 130 and the second inner pod 132 of the multi-use pillow 100. FIG. 3B depicts a first inner pod 130 and a second inner pod 132 which correspond to the size of the first enclosure 120 and second enclosure 122, respectively (illustrated in FIGS. 1 and 2). First and second inner pods 130 and 132 are intended to be inserted into the first enclosure and the second enclosure (120 and 122) of the multi-use pillow 100. First and second inner pods 130 and 132 are manufactured such that the first inner pod 130 may be inserted and fit into the first enclosure 120 of the multi-use pillow 100. Accordingly, second inner pod 132 may be inserted and fit into the second enclosure 122 of the multi-use pillow 100.

Figure 4A:
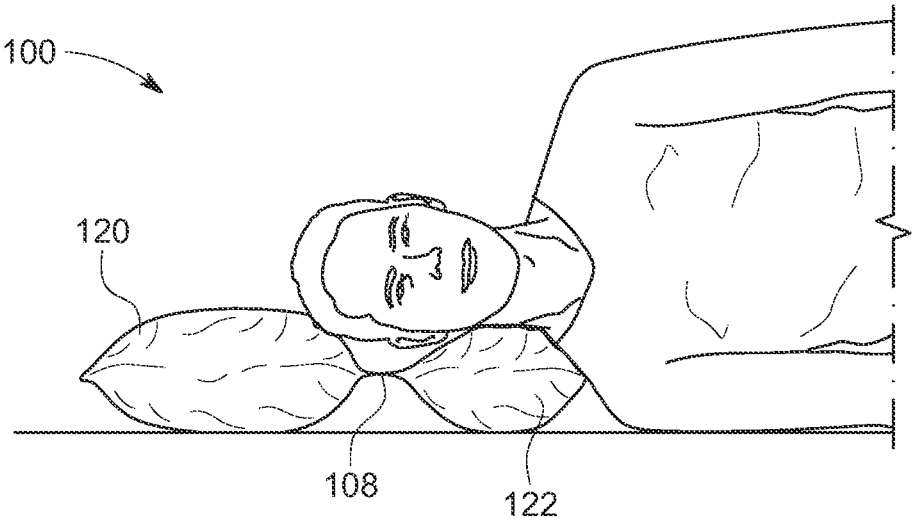
FIG. 4A is an illustration showing a side view of a preferred way to use the multi-use ergonomic pillow.
Figure 4B:
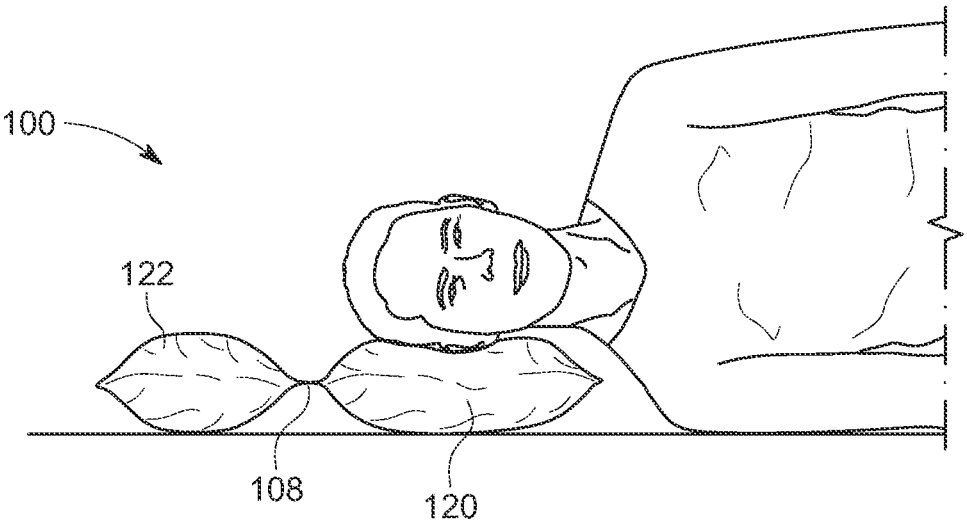
FIG. 4B is an illustration showing a side view of another preferred way to use the multi-use ergonomic pillow.
Figure 4C:
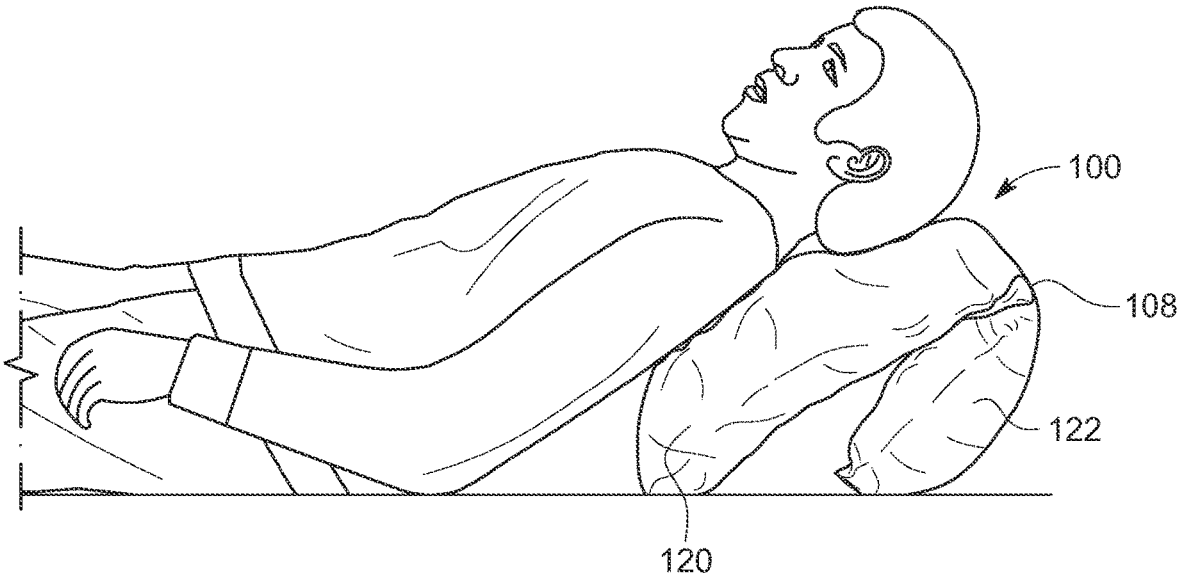
FIG. 4C is an illustration showing a side view of another preferred way to use the multi-use ergonomic pillow.

FIGS. 4A, 4B, and 4C illustrate some of the preferred ways to use the multi-use pillow 100. FIG. 4A illustrates one such way to use wherein an individual using the pillow is laying on his side and the convexity of the individual's head lies in the channel 108. In this position, the small enclosure section 122 may provide support to an individual's neck. FIG. 4B illustrates an individual preferring the support of the bigger section 120 for the placement of the head and the neck. Both these preferences may be supported by laying on the side, the back, or the stomach. FIG. 4C illustrates that the channel 108 may also be used so an individual can fold the multi-use pillow 100 at channel 108. In FIG. 4C, the individual is using the fold to lay on the back to support the shoulder, neck, and head. Generally, in each of these positions demonstrated in FIGS. 4A, 4B, and 4C, the shoulder to neck height of the pillow allows the head to be positioned without much bend of the neck such that a proper spinal architecture may be maintained.

Accordingly, the present description provides one of more embodiments for a useful pillow with therapeutic and ergonomic benefits. It may be an advantage of the multi-use ergonomic pillow, as described herein in one or more embodiments, that a user is able to customize the pillow to suit their sleeping habits and thus provide themselves a means to position their head and neck within the proper spinal architecture. Doing so provides the user with therapeutic benefits for chronic ailments related to poor positioning of the head and neck while laying down. Thus, the multi-use ergonomic pillow, as described through this document, offers an improved and useful pillow utilizing ergonomics.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention. The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A multi-use pillow, comprising:

an outer shell, the outer shell having a front side and a back side joined together at a top edge, a bottom edge, and a side edge wherein an opening exists at an open edge;

a first enclosure configured into the outer shell, the first enclosure having a length and a width, wherein the length is greater than the width and the open edge with the opening is along the width of the first enclosure;

a second enclosure configured into the outer shell, the second enclosure having a length and a width, wherein the length is greater than the width and the open edge with the opening is along the width of the second enclosure;

a channel separating the first enclosure and the second enclosure, wherein the channel is augmented with an inflexible material making the channel resistant to folding, wherein the inflexible material is permanently integrated into the channel;

a first inner pod encasing a fill material, wherein the first inner pod is substantially equal in the length and the width of the first enclosure; and a second inner pod encasing a fill material, wherein the second inner pod is substantially equal in the length and the width of the second enclosure.

2. The multi-use pillow of claim 1, wherein the first enclosure has a width longer than the width of the second enclosure.

3. The multi-use pillow of claim 1, wherein the first inner pod is received into the first enclosure through the opening along the open edge of the first enclosure; and wherein the second inner pod is received into the second enclosure through the opening along the open edge of the first enclosure.

4. The multi-use pillow of claim 1, wherein the channel is created by a first seam and a second seam, wherein the first seam runs along the length of the first enclosure from the open edge to the side edge and the second seam runs along the length of the second enclosure from the open edge to the side edge.

5. The multi-use pillow of claim 4, wherein the first seam and the second seam are parallel to the top edge and the bottom edge of the outer shell and parallel to each other.

6. The multi-use pillow of claim 1, wherein the channel has a width, and the width of the channel is chosen from a range of 0.5 inches to 1.5 inches.

7. The multi-use pillow of claim 1, wherein the outer shell containing the first inner pod in the first enclosure and the second inner pod in the second enclosure is foldable at the channel.

8. The multi-use pillow of claim 1, wherein the open edge on the first enclosure and the open edge on the second enclosure are integrated with closure means.

9. The multi-use pillow of claim 8, wherein the closure means comprises of an enveloping flap that encloses the first inner pod and the second inner pod in the first enclosure and the second enclosure, respectively.

10. The multi-use pillow of claim 9, wherein the first inner pod and the second inner pod each encase the fill material that is chosen from material which provides a range of density from soft, medium, and firm.

11. The multi-use pillow of claim 10, wherein the first inner pod and the second inner pod encase a similar density fill material.

12. The multi-use pillow of claim 10, wherein the first inner pod and the second inner pod encase a different density fill material.

13. A multi-use pillow, comprising:

an outer shell, the outer shell having a front side and a back side joined together at a top edge, a bottom edge, and a side edge wherein an opening exists at an open edge;

a first enclosure configured into the outer shell the first enclosure having a length and a width, wherein the length is greater than the width and the open edge with the opening is along the width of the first enclosure;

a second enclosure configured into the outer shell, the second enclosure having a length and a width, wherein the length is greater than the width and the open edge with the opening is along the width of the second enclosure;

wherein the open edge on the first enclosure and the open edge on the second enclosure are integrated with closure means;

a channel separating the first enclosure and the second enclosure, wherein the channel is created by a first seam and a second seam, wherein the first seam runs along the length of the first enclosure from the open edge to the side edge and the second seam runs along the length of the second enclosure from the open edge to the side edge, wherein the channel is augmented with an inflexible material making the channel resistant to folding, wherein the inflexible material is permanently integrated into the channel;

a first inner pod encasing a fill material, wherein the first inner pod is substantially equal in a length and a width of the first enclosure, wherein the first inner pod is received into the first enclosure through the opening along the open edge of the first enclosure;

a second inner pod encasing a fill material, wherein the second inner pod is substantially equal in a length and width of the second enclosure, wherein the second inner pod is received into the second enclosure through the opening along the open edge of the first enclosure; and wherein the outer shell containing the first inner pod in the first enclosure and the second inner pod in the second enclosure is foldable at the channel.

14. The multi-use pillow of claim 13, wherein the first enclosure has a width longer than the width of the second enclosure.

15. The multi-use pillow of claim 13, wherein the first enclosure and the second enclosure are substantially equal in size.

16. The multi-use pillow of claim 13, wherein the closure means comprises of an enveloping flap that encloses the first inner pod and the second inner pod in the first enclosure and the second enclosure, respectively.

17. The multi-use pillow of claim 13, wherein the first inner pod and the second inner pod each encase the fill material that is chosen from material which provides a range of density from soft, medium, and firm.

18. The multi-use pillow of claim 13, wherein the first inner pod and the second inner pod each encase a similar density fill material.

19. The multi-use pillow of claim 13, wherein the first inner pod and the second inner pod each encase a different density fill material from the other.

20. The multi-use pillow of claim 13, wherein the channel has a width, and the width of the channel is chosen from a range of 0.5 inches to 1.5 inches.

* * * * *